United States Patent [19]

Chen

[11] 4,441,716

[45] Apr. 10, 1984

[54] GOLF BALL INCLUDING ALIGNMENT MARKINGS AND GOLF BALL MARKING DEVICE

[76] Inventor: Richard M. Chen, 51-52 Goldsmith St., Elmhurst, N.Y. 11373

[21] Appl. No.: 282,054

[22] Filed: Jul. 10, 1981

[51] Int. Cl.[3] ..... A63B 69/36

[52] U.S. Cl. ..... 273/183 C; 40/327; 33/1 C; 101/DIG. 17; 273/200 R; 273/183 E; 273/186 D

[58] Field of Search ..... 33/1 C, 1 N, 1 BB, 174 F, 33/174 G, 174 P, 175; 101/DIG. 17, 368; 273/213, 183 C, 186 D, 199 R, 186 B, 194 A, 232; 40/327; D21/205

[56] References Cited

U.S. PATENT DOCUMENTS

| | | | |
|---|---|---|---|
| D. 27,441 | 7/1897 | Dunn | D21/205 |
| 41,698 | 8/1911 | Royce | D21/205 |
| D. 41,920 | 11/1911 | Cigol | D21/205 |
| D. 52,706 | 11/1918 | Robertson | D21/205 |
| 676,506 | 6/1901 | Knight et al. | 40/327 X |
| 917,132 | 4/1909 | Pulfrich | 33/1 N |
| 1,178,361 | 4/1916 | Van Sciver | 40/327 |
| 1,483,165 | 2/1924 | Eaton | 273/199 R |
| 3,081,091 | 3/1963 | Grow | 273/199 R X |
| 3,698,028 | 10/1972 | Panter et al. | 101/368 X |
| 4,163,421 | 8/1979 | Sihota | 101/41 |

FOREIGN PATENT DOCUMENTS

| | | | |
|---|---|---|---|
| 11171 | 5/1903 | United Kingdom | 273/213 |

*Primary Examiner*—George J. Marlo

[57] ABSTRACT

A golf alignment marker system is disclosed wherein a calibrated grid is provided on a golf ball and a golf club face is provided with a marking surface whereby when the club strikes the ball, a mark is imparted to the ball surface at a specific location within the grid. The golfer may then correlate the marked spot with the ball flight. A reader is provided to assist in reading the exact marked spot and a chart provides an analysis of the deviation of the marked spot with the correct impact point. An alignment scope permits proper orientation of the calibrated grid when the ball is placed on a tee. The invention may also be embodied in a training device for an accurate determination of the club swing and club face orientation. The golf alignment marker system of the present invention economically assists the golfer in determining the exact three dimensional orientation of the club face at the moment the ball is struck.

10 Claims, 11 Drawing Figures

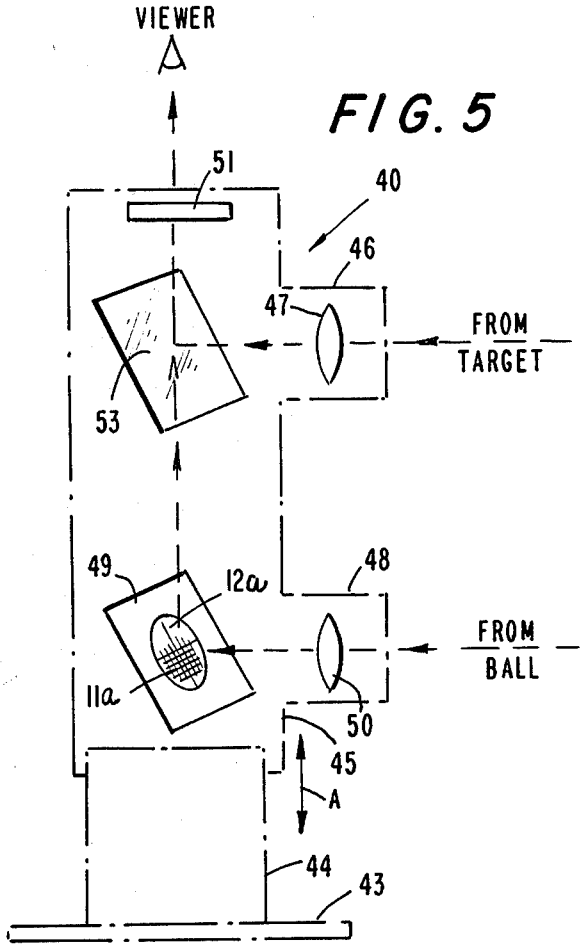
FIG. 5
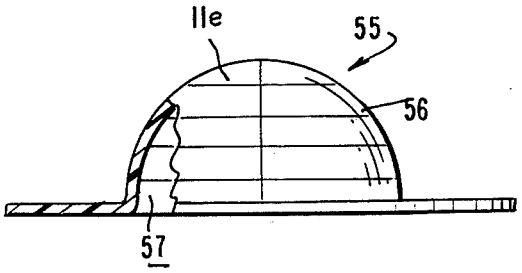
FIG. 7
FIG. 6
| LOFT | STRAIGHT | LEFT | RIGHT |
|---|---|---|---|
| DRIVER | STR. DRAW FADE | DRAW PULL HOOK | FADE PUSH SLICE |
| 5-IRON | STR. | PULL DRAW | PUSH FADE |
| 9-IRON | STR. | PULL | PUSH |
59 59 58

FIG. 9
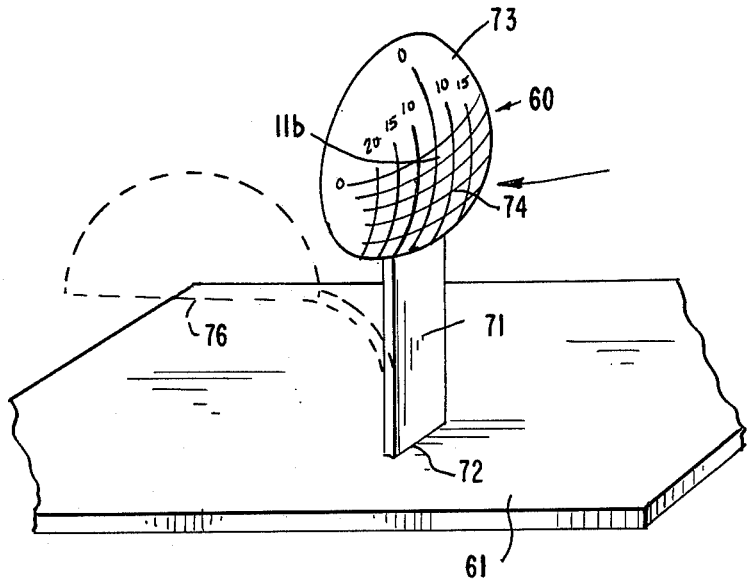
FIG. 8
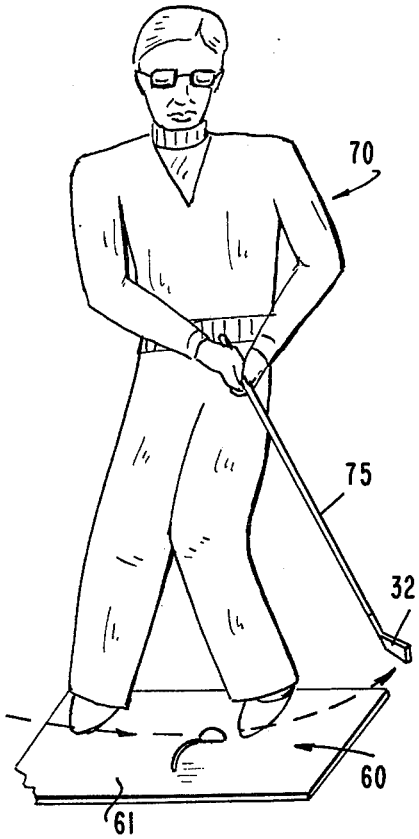
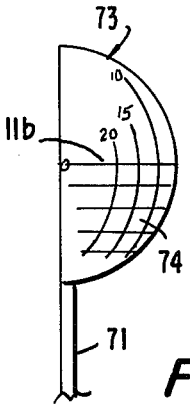
FIG. 10
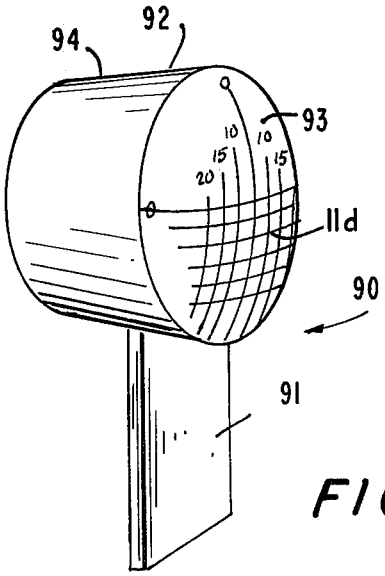
FIG. 11

GOLF BALL INCLUDING ALIGNMENT MARKINGS AND GOLF BALL MARKING DEVICE

FIELD OF THE INVENTION

This invention relates to a golf teaching device and system. Specifically this invention relates to a golf alignment and marker system as an accurate training aid for golfers.

BACKGROUND AND DISCUSSION OF THE PRIOR ART

Heretofore it was known in the prior art to place various markings on a golf ball for alignment with regards to a golf club. Typical of such prior art devices is the equatorial markings as disclosed in Yamamoto, U.S. Pat. No. 4,209,172, granted June 24, 1980, the cross-marking of Fyanes, U.S. Pat. No. 3,325,168, granted June 13, 1967; the ink line of DeVries, U.S. Pat. No. 2,709,595, granted May 31, 1955, and the diffraction markings of Ciccarello, U.S. Pat. No. 4,235,441, granted Nov. 25, 1980.

It was also known in the art to provide diverse sighting devices, such as in Branberg, U.S. Pat. No. 3,729,199; Krupicka, U.S. Pat. No. 4,251,076, granted Feb. 17, 1981; and Zank, U.S. Pat. No. 3,874,672, granted Apr. 1, 1975.

In other aspects, the prior art also recognized marking a record paper surface by the golf ball-club impact, such as the NCR paper impact marker of Manheck, U.S. Pat. No. 3,754,764, granted Aug. 28, 1973.

Now there is provided by the present invention a golf ball alignment marker for golf training which provides a high degree of accuracy.

It is therefore a principal object of the present invention to provide a novel golf ball alignment marker.

It is another object of the present invention to provide a club marking surface and golf ball alignment device which provides a high degree of accuracy in determining the exact hit location on the golf ball.

It is another object of the present invention to provide a reader to be used with the said alignment marker for accurately determining the strike point on the golf ball.

It is another object of the present invention to provide a means for providing alignment markings on a golf ball.

It is still a further object of the present invention to provide a scope for utilizing the alignment marker system on an actual golf course.

It is a further object of the present invention to determine the club face orientation.

It is still a further object of the present invention to provide a golf training device utilizing the golf alignment marker, which training device can readily be used indoors.

Another object of the present invention is to provide a golf ball alignment marker which is readily constructed of relatively inexpensive materials and yet practical in design and operation.

BRIEF DESCRIPTION OF THE DRAWINGS

FIG. 5 is an elevational schematic illustration of the alignment scope of FIG. 4;

FIG. 6 is a partial view of a reader's chart for interpreting the impact mark on the grid golf ball;

FIG. 7 is a sectional partial fragmentary view of an impact mark locator;

FIG. 8 is a perspective view of a golfer utilizing an alignment marker device pursuant to the present invention;

FIG. 9 is an enlarged perspective view of the device of FIG. 8;

FIG. 10 is an elevational view of the device of FIG. 9; and

FIG. 11 is a perspective view of an alternate embodiment of the device of FIGS. 9–10.

DESCRIPTION OF THE PREFERRED EMBODIMENTS

Figure 1:
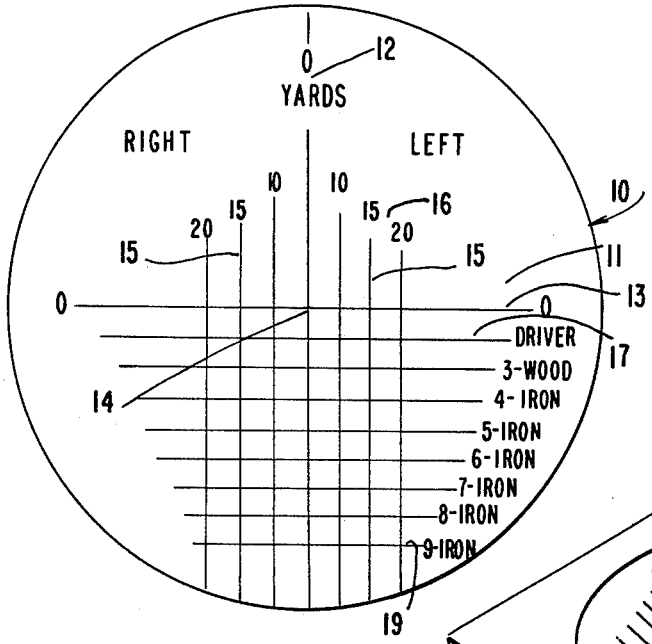
FIG. 1 is a greatly enlarged elevational view of the front face of golf ball showing grid markings embodying the present invention.

Referring to FIG. 1, there is shown the golf ball of the present invention generally referred to as numeral 10. Ball 10 may be of conventional size and shape with dimples, or may be a practice ball of smooth surface as depicted in FIG. 1. Ball 10 is provided with a plurality of markings 11 which may be permanently imprinted on one hemisphere of the ball. Markings 11 comprise a vertical line 12 and horizontal line 13 which lines lie on the arcs of respective great circles, and are perpendicularly disposed to each other at central cross-mark 14. A plurality of lines 15 are in parallel disposition to vertical line 12 and disposed on opposite sides of line 12. The lines are spaced from vertical line 12 and indicate angular deviations from the vertical, and may be marked with specific notations 16. The notations may be angular notations, and also represent yardage deviation for a specific average drive shot distance, such as "5", "10" "15" yards "right" and "left" as seen in FIG. 1. A second plurality of lines 17 are in parallel disposition to and spaced from horizontal line 13. Each such horizontal line represents and contains a lift indication (for the angle of a specific club face) 19 for various golf clubs. Those clubs with the greater angular club face such as the "8-Iron" or "9-Iron" are lower on the ball to indicate the greater degree of lift if the ball is struck properly by that specific club. A specific point on the ball grid will then coincide to a specific vertical and horizontal component, and its deviation with respect to the correct impact point for a certain club, as will be more fully explained hereinafter.

Figure 2:
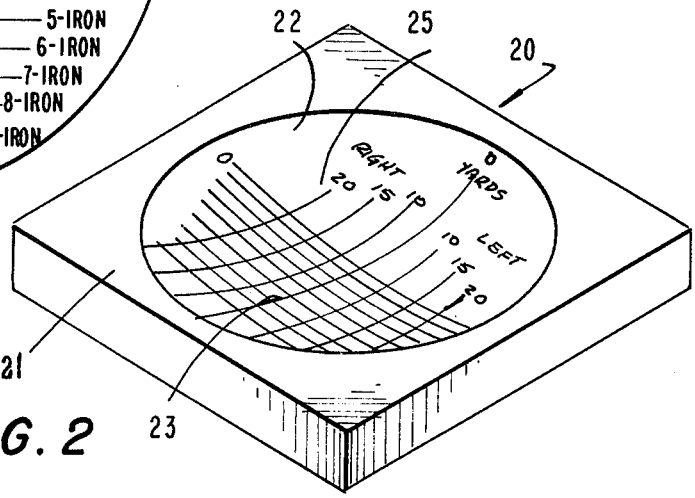
FIG. 2 is a perspective view of a device for applying the grid markings as depicted in FIG. 1.

While the markings 11 may be permanently imprinted on the ball, it is also contemplated that a conventional golf ball can be imprinted with the markings. In FIG. 2 there is disclosed a marking device 20 which is formed of a wooden block 21 which is formed with a recess or depression 22 of hemispherical shape. Depression 22 is sized so as to accommodate a conventional golf ball. A plurality of grooves 23 are formed at the bottom of depression 22, which grooves correspond to the markings 11 of ball 10. In this manner of construction, ink by means of a felt marker or swab is spread over the depression surface 25 so as fill grooves 23. The excess ink is wiped from the surface and the surface finish of 25 repels the ink, so that the ink remains in the grooves 23 but not on surface 25. The golf ball 10 is then pressed into the depression to receive the ink from the grooves and the ball allowed to dry. The ball is then ready for use in play.

Figure 3:
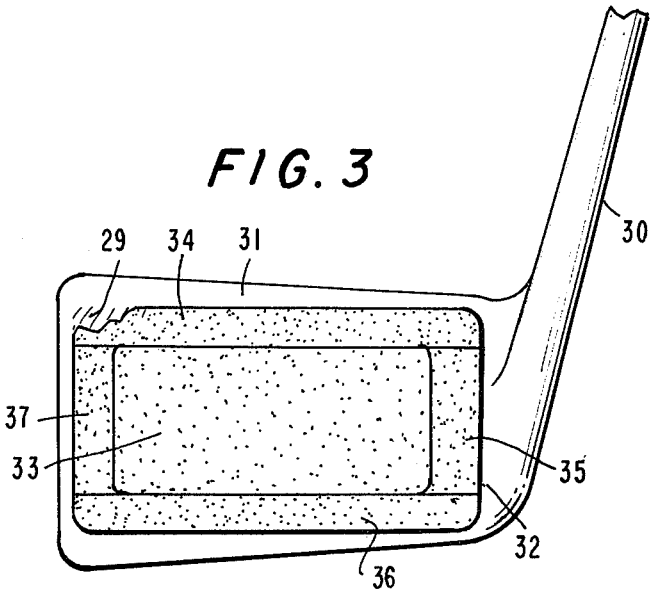
FIG. 3 is a front partial fragmentary view of a golf club utilizing a marking element for use in conjunction with the ball of FIG. 1.

In utilizing the ball, reference is made to FIG. 3, wherein golf club 30 is shown with club face 31. A chalked pad 32 is adhesively secured to face 31 by pressure sensitive releasable adhesive 29 as is well known in the art. Pad 32 is formed with chalked or inked portions or zones 33–37, representing in seriatim, the central portion 33, the top central portion 34, the right side portion 35, the bottom central portion 36 and the left side portion 37. Each portion or zone is differently colored, namely, black 33, yellow 34, orange 35, red 36 and blue 37. In this manner of construction when the club face strikes the ball a specifically colored mark will be imparted to the ball indicating what portion of the club struck the ball. Pursuant to present invention the imparted mark on the ball will also indicate the angular vertical deviation as well as the lift impact point, thus providing the player with an indication of the deviation from the desired impact point for that club (FIG. 6).

Figure 4:
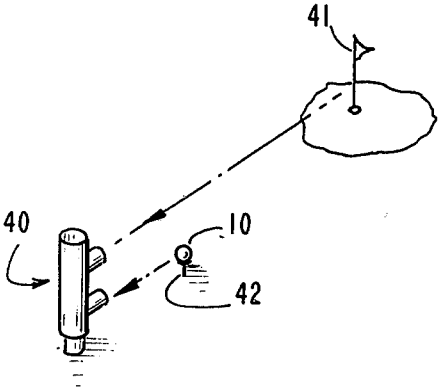
FIG. 4 is a schematic illustration of utilization of the alignment scope and grid marked ball.

Referring now to FIGS. 4 and 5, there is shown the utilization of scope 40 for insuring proper alignment of the ball with the target 41 and position on tee 42. Scope 40 is formed of base 43, upright mount member 44 and main housing 45. Housing 45 is slidably positionable on support member 44 for adjusting the scope height A in relation to height of the ball on the tee or ground surface. Housing 45 is formed of target scope 46 comprising a lens or lens system 47 for imaging the target or flag pole 41, and a ball scope 48 for imaging ball 10. A half-silver mirror 53 is disposed in housing 45 to receive the target image and in part transport the image to mirror 49. Mirror 49 is permanently imprinted with a replica **11*a* of grid markings 11. Thus, the target image is superimposed on mirror 49, which also receives an image of ball 10 through lens or lens system 50. An eye piece 51 is also provided in the line of sight with angled mirrors 53 and 49. By first adjusting the height of housing 45 so that ball 10 height, or more specifically the ball grid marking height, corresponds to grid 11*a* height, and then rotating the ball so that the grid markings 11 and 11*a* are coincident when viewed in the scope as determined through eye piece 51, and the flag is superimposed vertically on vertical line 12*a*, then it is determined that ball 10 and specifically the markings thereon are true to the horizontal and vertically aligned to the flag pole 41**.

In the manner afore-described, the player hits the ball 10 with the club and pad (as in FIG. 3), and the ball flight is noted by the player. On retrieving the ball, the player notes the mark on the ball and determines the impact point, and specifically the deviation from the correct spot or "sweet spot" for that club and stroke.

Very often the mark on the ball may be larger than the desired single minute spot, and the exact epicenter of the spot would have to be located. To achieve this a transparent plastic hemisphere 55 may be provided. Surface 56 of hemisphere 55 is imprinted with grid markings **11*e* similar to 11 whereby the epicenter of the imparted mark may be located. The deviation reading can then be more accurately determined with the impact point marked ball inserted within hollow 57 of device 55**.

Referring to FIG. 6, there is shown a portion of chart 58 which correlates the impact markings with the specific club used the golfer and notations 59 indicate the nature of the deviation to assist.

Referring now to FIGS. 8–10, there is shown a golf training device 60 embodying the present invention. Device 60 comprises a base 61 of sufficient size so that a player 70 can position his body on the base to hold the base down in place. An upright flexible plastic member or tee 71 is fixedly attached to the base 61 at 72 by well known means. An object ball 73 is hemispherically shaped (FIG. 10) having curved surface 74 and is formed of highly impact resistant material, such as Delrin, and the like. A series of grid markings **11*b* are imprinted on surface 74, which marks 11*b* are similar to markings 11 hereinbefore discussed. In use, golfer 70 positions himself on base 61 in relation to object ball 73**.

Club 75 is provided with a marking pad **32*a* similar to that hereinbefore described in connection with FIG. 3. Golfer 70 strikes object ball 73 with club 75 and specifically pad 32*a* imparting a chalk mark on surface 74. The object ball or more specifically tee 71 flexes downwardly to position 76** so as to permit a free swinging action as depicted, without impairment of the natural swing of the golfer. The golfer then notes the impact point direction. The ball is then wiped clean, and the golfer tries again in an attempt to correct the swing to reduce the deviation of the impact point from the desired impact point.

Device 60 has the important advantage of being useful in an enclosed environment such as a home or office.

It is also within the contemplation of the present invention to modify the object ball, so that the surface is oblongated such as shown in the device 90 of FIG. 11. Device 90 comprises a base (not shown) and support tee 91, similar to that described in connection with the embodiment of FIGS. 8–10. Object ball 92 comprises a curved oblongated surface 93, supported on oblongated cylindrical backing 94, with grid markings **11*d* on 93. Markings 11*d*, by virtue of the oblongated surface are spaced further apart than those on the hemispherical surfaces previously discussed. Surface 93** is in fact oblongated in the vertical but more true to the sphere in the horizontal. Impact markings on the ball will then be more readily read because of the greater spacing of the lines.

While the present invention is particularly useful to improve driving shots, it can as well be used to improve putting as well as fairway shots, such invention assisting the golfer in getting the head of his golf club squared to the intended line of ball path direction and aligned with the sweet spot or correct impact point on the ball.

It is to be understood that the forms of my invention herein shown and described are to be taken as preferred examples of the same and that various changes in the shape, size and arrangement of parts may be resorted to without departing from the spirit of my invention, or the scope of the subjoined claims.

What is claimed is:

1. A golf alignment device comprising; a golf ball being formed with markings on said ball, said markings comprising first and second perpendicularly crossed lines, and a first plurality of lines parallel to said first line, and a second plurality of lines parallel to said second line, whereby the first line and first plurality of lines are determinative of the angular direction of the ball flight and the second line and second plurality of lines are determinative of the arc of the ball flight with respect to the horizontal, said pluralities of lines lying in one hemisphere of said ball, said lines of said first plurality bearing respective notations as to the angular deviation of the ball flight with respect to the vertical, said second plurality of lines bearing respective notations as to the arc of the ball flight, said ball in use being aligned so that the one hemisphere and crossed lines face the direction of golf club impact, and whereby when the golf club impacts the ball, an impact mark is produced in said one hemisphere, and wherein the center of the impact mark relative to said lines determines the angular deviation and arc of the flight of the ball as denoted by said notations.

2. The golf alignment device of claim 1, said pluralities of lines crossing so as to form a grid.

3. The golf alignment device of claim 1, further comprising a marking pad, and means to mount said marking pad to a golf club face, whereby when the club strikes said ball a mark is made on said grid.

4. The golf alignment device of claim 3, said pad comprising a plurality of zones, each of said zones comprising a different color component, whereby the colored mark on said ball determines the region of the club which impacted the ball.

5. The golf alignment device of claim 4, said zones comprising a central zone, a top central zone, a bottom central zone, a right side zone, and a left side zone.

6. The golf alignment device of claim 5, further comprising means to align said golf ball on a tee so that said first and second lines are trued with the vertical and horizontal.

7. The golf alignment device of claim 6, further comprising means to align said vertical with a vertical target.

8. The golf alignment device of claim 1, said first plurality of notations being numbers in ascending order to the right and to the left of the first line.

9. The golf alignment device of claim 1, said second plurality of notations comprising notations for different woods and irons.

10. The golf alignment device of claim 1, said first plurality of notations being numbers relative to the yardage deviation for the average drive shot and said second plurality of notations being numbers relative to different clubs for the drive shot.

* * * * *